US007226326B2

(12) United States Patent
Mizuguchi et al.

(10) Patent No.: US 7,226,326 B2
(45) Date of Patent: Jun. 5, 2007

(54) OUTBOARD MOTOR STEERING ANGLE AND TILT/TRIM ANGLE REGULATING SYSTEM

(75) Inventors: Hiroshi Mizuguchi, Saitama (JP); Hideaki Takada, Saitama (JP)

(73) Assignee: Honda Motor Co., Ltd, Tokyo (JP)

( * ) Notice: Subject to any disclaimer, the term of this patent is extended or adjusted under 35 U.S.C. 154(b) by 114 days.

(21) Appl. No.: 11/143,348

(22) Filed: Jun. 2, 2005

(65) Prior Publication Data

US 2005/0272322 A1 Dec. 8, 2005

(30) Foreign Application Priority Data

Jun. 3, 2004 (JP) ..... 2004-165678

(51) Int. Cl.
*B63H 5/125* (2006.01)
*B63H 5/20* (2006.01)

(52) U.S. Cl. ..... 440/61 R; 440/53

(58) Field of Classification Search ..... None
See application file for complete search history.

(56) References Cited

U.S. PATENT DOCUMENTS 6,908,350 B1 * 6/2005 Roessler et al. ..... 1/1
2003/0224673 A1 * 12/2003 Takada et al. ..... 440/84

FOREIGN PATENT DOCUMENTS

JP 62-125996 6/1987
JP 07-228296 8/1995

* cited by examiner

*Primary Examiner*—Jesus Sotelo
*Assistant Examiner*—Daniel V. Venne
(74) *Attorney, Agent, or Firm*—Carrier, Blackman & Associates, P.C.; Joseph P. Carrier; William D. Blackman

(57) ABSTRACT

An outboard motor steering angle and tilt/trim angle regulating system includes a pair of hydraulic cylinders each connected, at one end, to the boat through the stern brackets and connected, at the other end, to the outboard motor at a location upward of the one end in a vertical direction, and a control unit inputting the outputs of a steering angle sensor, a power tilt switch and a power trim switch and selectively driving the hydraulic cylinders to extend or retract, to regulate a steering angle and tilt/trim angles of the outboard motor relative to the boat in response to at least one of the inputted outputs. With this, while utilizing hydraulic cylinders, it becomes possible to simplify the structure to improve mountability on the outboard motor and hold weight increase to the minimum.

9 Claims, 7 Drawing Sheets

OUTBOARD MOTOR STEERING ANGLE AND TILT/TRIM ANGLE REGULATING SYSTEM

BACKGROUND OF THE INVENTION

1. Field of the Invention

This invention relates to an outboard motor steering angle and tilt/trim angle regulating system, particularly to an outboard motor steering angle and tilt/trim angle regulating system that uses actuators to regulate steering angle and tilt/trim angles.

2. Description of the Related Art

An outboard motor generally comprises stern brackets that are fixed to the stem of a hull (boat) and an outboard motor main unit incorporating an internal combustion engine, propeller and the like, and is structured so that the steering angle and tilt/trim angles of the outboard motor relative to the stern brackets, i.e., the steering angle and tilt/trim angles relative to the boat, can be regulated as desired. However, a system that requires such regulation to be done manually puts a heavy burden on the operator.

Attempts have therefore been made to reduce the burden on the operator. Japanese Laid-Open Patent Application No. Sho 62(1987)-125996, in particular its FIG. 2, for example, teaches a system that enables regulation of the steering angle of an outboard motor main unit by actuators, while Japanese Laid-Open Patent Application No. Hei 7(1995)-228296, in particular its FIGS. 2 and 3, teaches a system that enables regulation of the outboard motor main unit tilt and trim angles by multiple (specifically, three) hydraulic cylinders.

In the prior art, however, regulation of both the steering angle and the tilt/trim angles of the outboard motor main unit by actuators requires separate installation of the hydraulic cylinder for steering angle regulation of '996 and the hydraulic cylinders for tilt and trim angle regulation of '296. This complicates the structure, thus lowering mountability on the outboard motor and adding to overall weight.

SUMMARY OF THE INVENTION

An object of this invention is therefore to overcome these drawbacks by providing an outboard motor steering angle and tilt/trim angle regulating system that, while utilizing actuators, simplifies the structure to improve mountability on the outboard motor and hold weight increase to the minimum.

In order to achieve the object, this invention provides a system for regulating steering angle and tilt/trim angle of an outboard motor mounted on a stern of a boat through stern brackets and having an internal combustion engine and a propeller powered by the engine to propel the boat, comprising: a steering wheel installed near a seat of an operator of the boat to be manipulated by the operator; a steering angle sensor generating an output indicative of a steering angle of the steering wheel manipulated by the operator; a power tilt switch operable by the operator and generating an output indicative of an instruction to tilt up/down the outboard motor relative to the boat when operated; a power trim switch operable by the operator and generating an output indicative of an instruction to trim up/down the outboard motor relative to the boat when operated; a pair of hydraulic cylinders each connected, at one end, to the boat through the stern brackets and connected, at the other end, to the outboard motor at a location upward of the one end in a vertical direction; and a control unit inputting the outputs of the steering angle sensor, power tilt switch and power trim switch and selectively driving the hydraulic cylinders to extend or retract, to regulate the steering angle and tilt/trim angle of the outboard motor relative to the boat in response to at least one of the inputted outputs.

BRIEF DESCRIPTION OF THE DRAWINGS

The above and other objects and advantages of the invention will be more apparent from the following description and drawings in which.

DETAILED DESCRIPTION OF THE PREFERRED EMBODIMENT

Outboard motor steering angle and tilt/trim angle regulating systems according to preferred embodiment of the present invention will now be explained with reference to the attached drawings.

Figure 1:
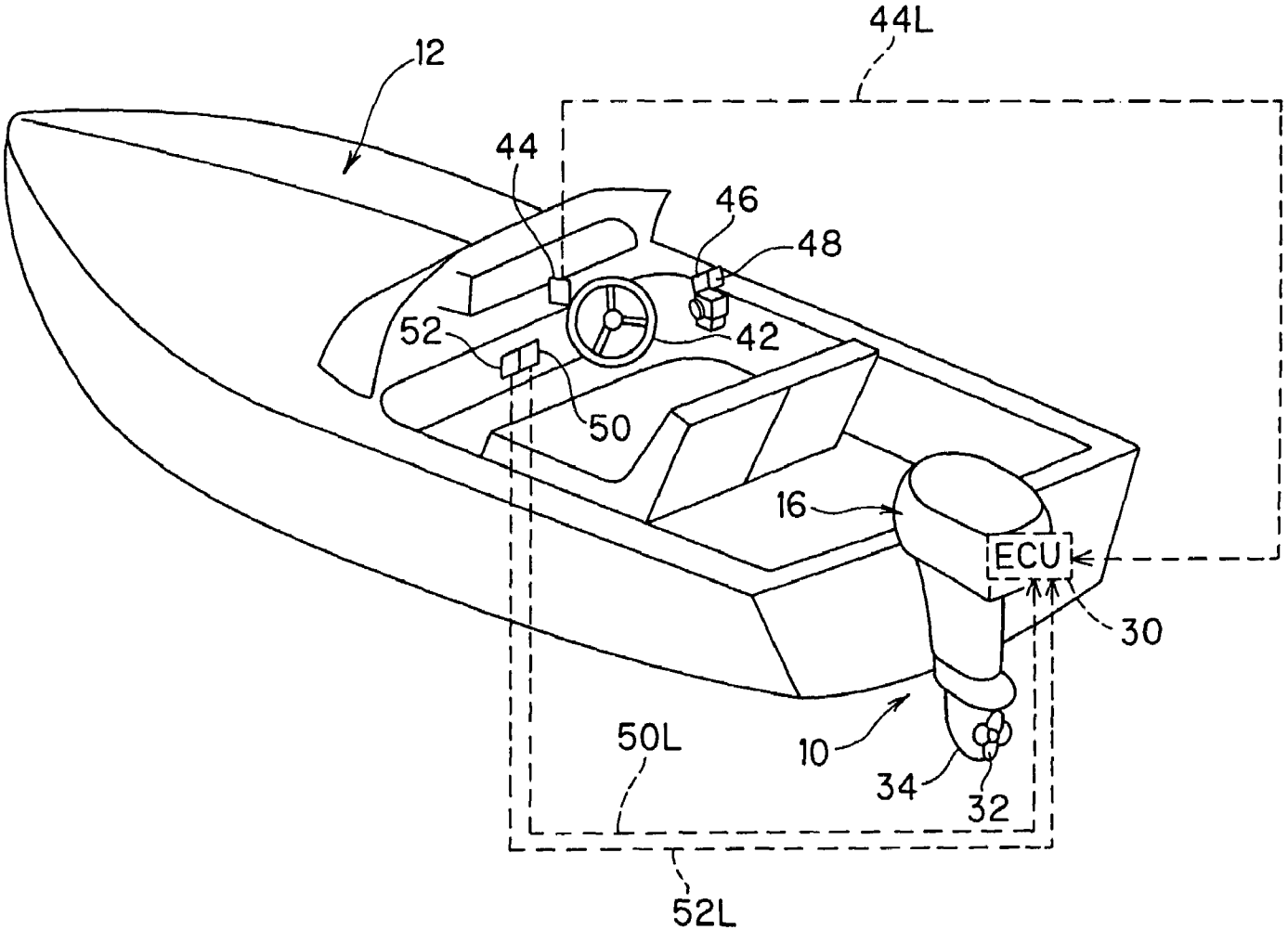
FIG. 1 is an overall schematic view of an outboard motor steering angle and tilt/trim angle regulating system according to an embodiment of the invention, with primary focus on the outboard motor.
Figure 2:
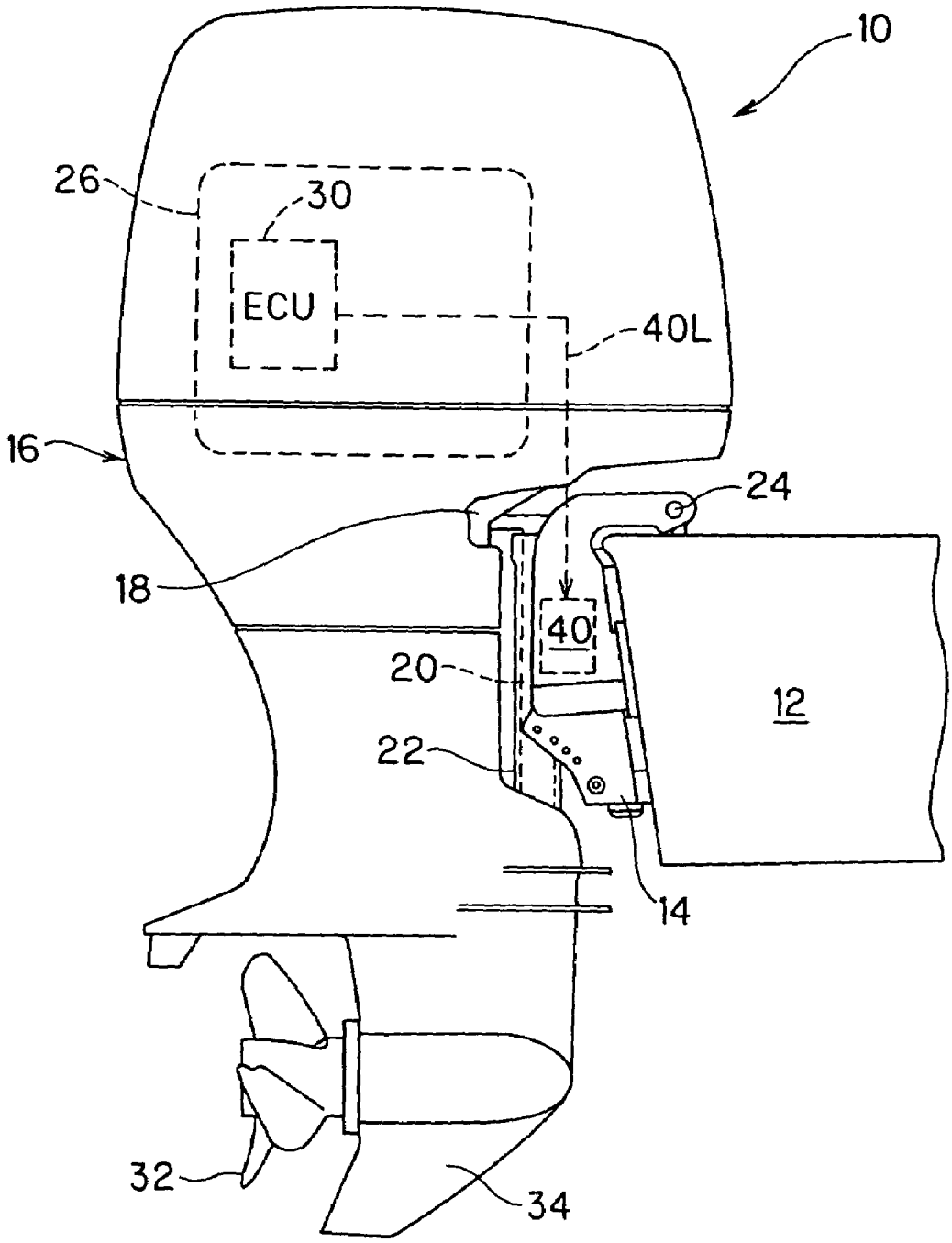
FIG. 2 is an explanatory partial side view of the system shown in FIG. 1.

FIG. 1 is an overall schematic view of an outboard motor steering angle and tilt/trim angle regulating system according to an embodiment of the invention, with primary focus on the outboard motor, and FIG. 2 is an explanatory partial side view of the system.

Reference numeral 10 in FIGS. 1 and 2 designates an outboard motor. As illustrated in FIG. 2, the outboard motor 10 comprises stern brackets 14 mounted the stern of a hull (boat) and an outboard motor main unit 16 fastened to the stern brackets 14.

The outboard motor main unit 16 is equipped with a swivel shaft 20 fastened to a unit's frame 18 and a swivel case 22 that rotatably accommodates the swivel shaft 20. The swivel case 22 is fastened to the stern brackets 14 through a tilting shaft 24. This structure enables the outboard motor main unit 16 to be steered relative to the stern brackets 14 by swiveling it about the swivel shaft 20 and to be tilted up and down and trimmed up and down by rotating it around the tilting shaft 24.

The outboard motor main unit 16 is equipped with an internal combustion engine (hereinafter referred to simply as "engine") 26 at its upper portion. The engine 26 is a spark-ignition, in-line, four-cylinder, four-cycle gasoline engine with a displacement of 2,200 cc. An electronic control unit (ECU) 30 constituted of a microcomputer is installed near the engine 26.

The outboard motor main unit 16 is equipped at its lower part with a propeller 32 and a rudder 34. The propeller 32, which operates to propel the boat 12 in the forward and reverse directions, is powered by the engine 26 through a crankshaft, drive shaft, gear mechanism and shift mechanism (none of which is shown).

A plurality of actuators 40, specifically a pair of hydraulic cylinders (explained later) are installed near the stern brackets 14 for regulating the steering angle, tilt angle and trim angle of the outboard motor main unit 16 relative to the stern brackets 14. The actuators 40 are electrically connected to the ECU 30 through a signal line 40L. Owing to the fact that the stern brackets 14 are fastened to the boat 12, the "steering angle, tilt angle and trim angle of the outboard motor main unit 16 relative to the stern brackets 14" can be called the "steering angle, tilt angle and trim angle of the outboard motor main unit 16 relative to the boat 12." More specifically, the trim angle is an angle of the transom (where the stern brackets 14 are fastened to the boat 12) relative to the longitudinal center line of the boat 12 (seen from sideway), in other words, this is the same as the angle of boat's bottom relative to the water surface level (i.e., the trim angle of the boat). The tilt angle is similar to the trim angle, but indicates an angle where the outboard motor main unit 16 is further tilted up, beyond the range of trim angle), to be lifted above the water.

As shown in FIG. 1, a steering wheel 42 is installed near the operator's seat of the boat 12. A steering angle sensor 44 is installed near the steering wheel 42. The steering angle sensor 44 is actually a rotary encoder that generates or outputs a signal in response to the steering angle (control input) of the steering wheel 42 inputted by the operator.

A shift lever 46 and a throttle lever 48 are also installed near the operator's seat. The shift lever 46 and throttle lever 48 are connected to the shift mechanism and a throttle valve of the engine 26 through push-pull cables (none of which are shown). Thus the shift mechanism can be operated to change the direction of boat 12 travel by manipulating the shift lever 46, and the throttle valve can be opened and closed to regulate the engine speed and speed of the boat 12 by manipulating the throttle lever 48.

A power tilt switch 50, operable by an operator for inputting instructions to regulate the tilt angle of the outboard motor main unit 16 and a power trim switch 52, operable by the operator for inputting instructions to regulate the trim angle of outboard motor main unit 16 are further installed near the operator's seat. The switches 50, 52 generate or output signals in response to tilt up/down and trim up/down instructions of the outboard motor main unit 16 inputted by the operator. Since the tilt angle and trim angle are both values indicating angles of rotation of the outboard motor main unit 16 about the tilting shaft 24, they will sometimes be referred to as tilt/trim angles in the following explanation.

The outputs of the steering angle sensor 44, power tilt switch 50 and power trim switch 52 are sent to the ECU 30 over signal lines 44L, 50L and 52L. Based on these input values, the ECU 30 drives the actuators 40 to regulate the steering angle and tilt/trim angles of the outboard motor main unit 16.

Figure 3:
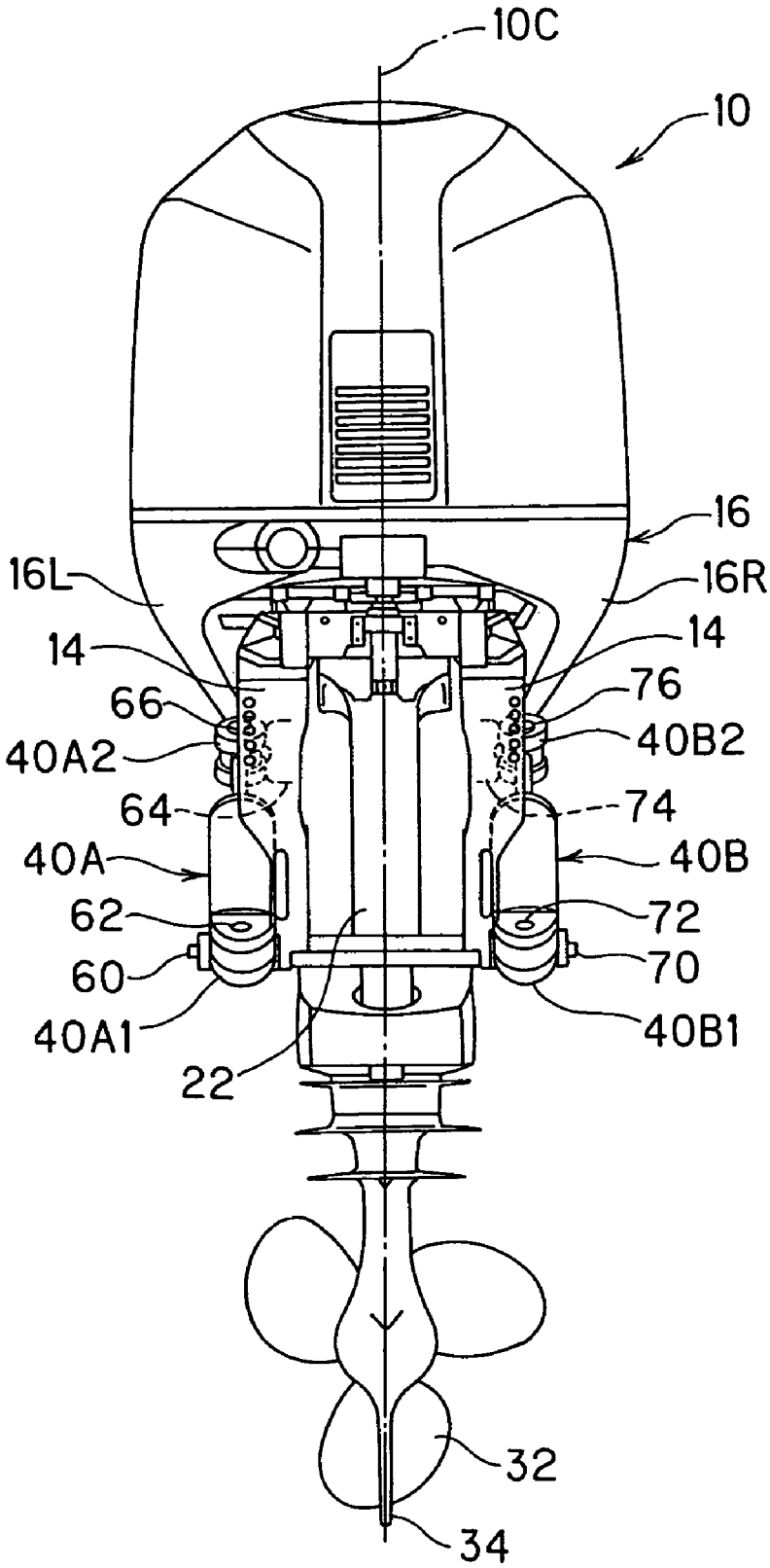
FIG. 3 is a front view of the outboard motor shown in FIG. 1.
Figure 4:
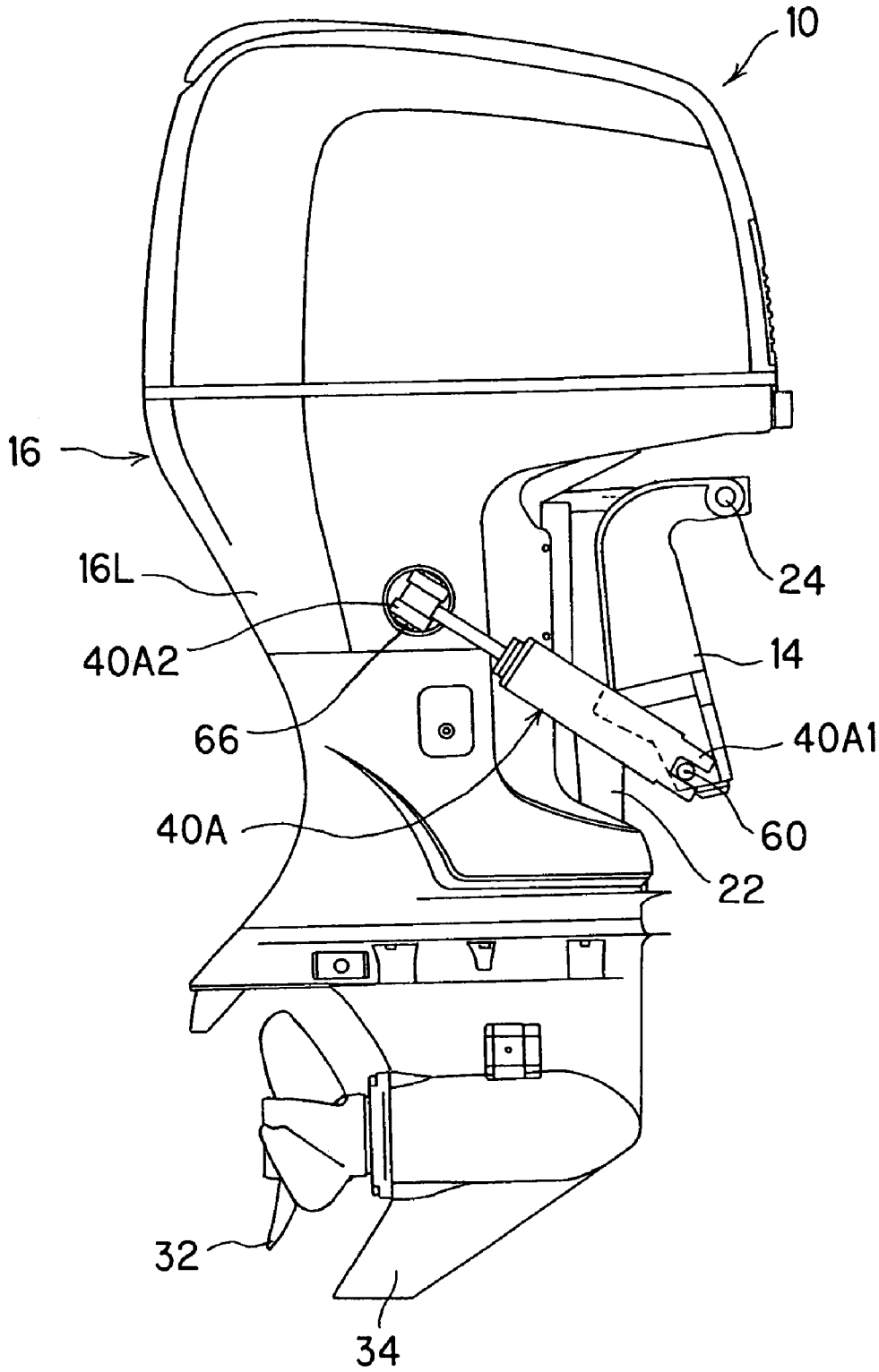
FIG. 4 is a left side view of the outboard motor shown in FIG. 1.

FIG. 3 is a front view of the outboard motor 10 (seen from the side of the boat 12). FIG. 4 is a left side view of the outboard motor 10.

As shown in FIGS. 3 and 4, the actuators 40 comprise a first hydraulic cylinder 40A and a second hydraulic cylinder 40B respectively located on the left and right sides of the outboard motor 10. As shown in FIG. 3, the hydraulic cylinders 40A, 40B are located at laterally symmetric positions on opposite sides of the center (lateral center indicted by symbol 10C) of the outboard motor 10. As shown in FIG. 4, they are inclined relative to the vertical axis (the axis of gravitation). The hydraulic cylinders 40A, 40B are reciprocating cylinders that are connected to a hydraulic circuit (not shown) installed on the outboard motor main unit 16 to be supplied with operating hydraulic pressure.

Figure 5:
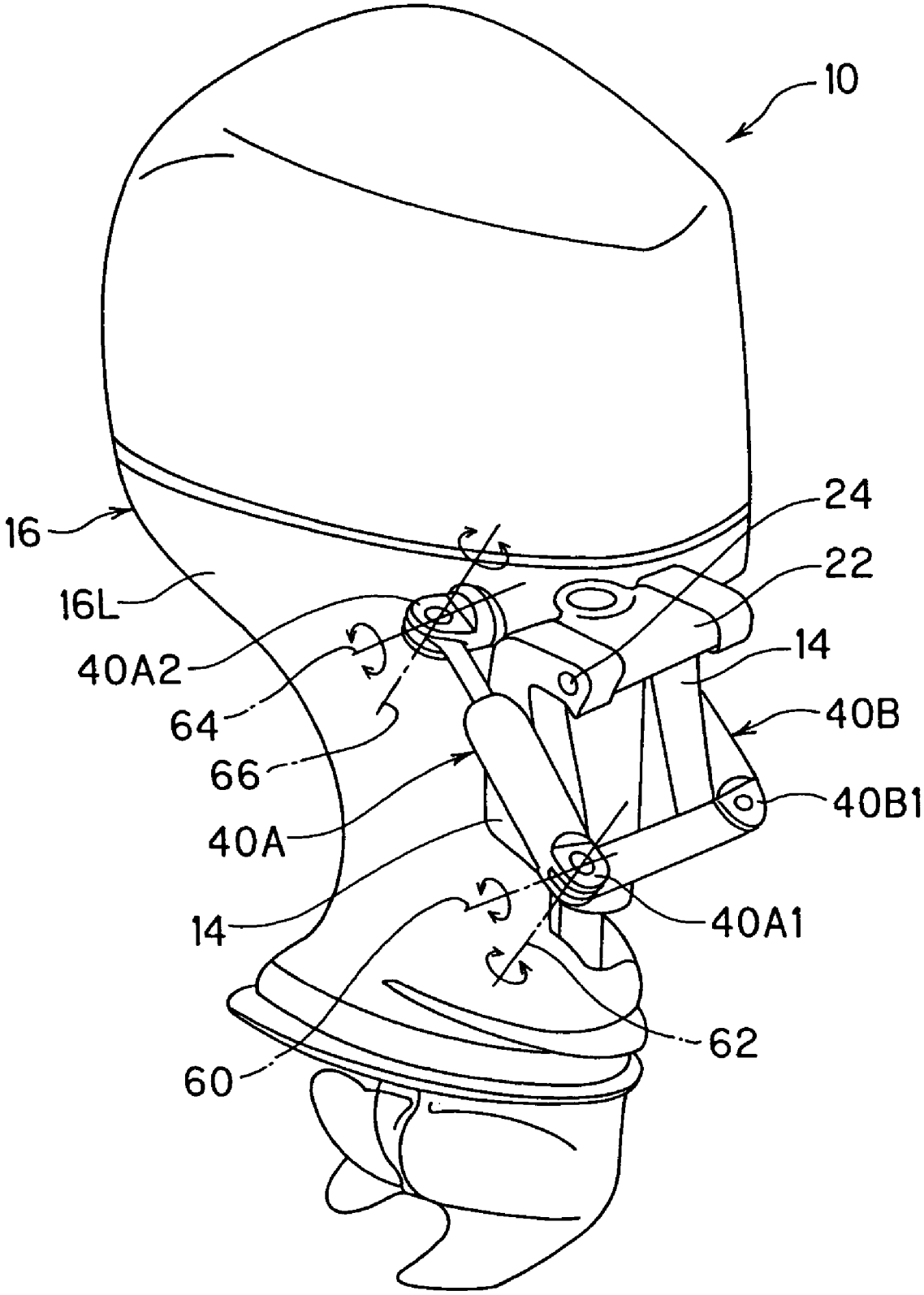
FIG. 5 is a simplified perspective view of the outboard motor shown in FIG. 1.

One end of the first hydraulic cylinder 40A (cylinder bottom 40A1) is connected to one of the stern bracket 14 (i.e., a part whose angle relative to the boat 12 does not change) at a point near the lower end of the left side face thereof. Specifically, a rotatable shaft 60 that can rotate relative to the stern bracket 14 about a lateral axis is provided near the lower end of the left side face of the stern bracket 14. Further, a rotatable shaft 62 that can rotate about an axis lying perpendicular to the lateral axis is connected to the rotatable shaft 60 and the cylinder bottom 40A1 is connected to the rotatable shaft 62. In other words, as best shown in FIG. 5, the cylinder bottom 40A1 is capable of angular displacement relative to the stern bracket 14 about two axes, namely the lateral axis defined by the rotatable shaft 60 and the axis perpendicular thereto defined by the rotatable shaft 62.

The other end of the first hydraulic cylinder 40A (rod head 40A2) is connected to the left side face 16L of the outboard motor main unit 16 at a location upward of the cylinder bottom 40A1 in the vertical direction. Specifically, a rotatable shaft 64 that can rotate relative to the outboard motor main unit 16 about a lateral axis is provided on the left side face 16L at a location upward of the rotatable shafts 60, 62. Further, a rotatable shaft 66 that can rotate about an axis lying perpendicular to the lateral axis is connected to the rotatable shaft 64 and the rod head 40A2 is connected to the rotatable shaft 66. In other words, as best shown in FIG. 5, the rod head 40A2 is capable of angular displacement relative to the outboard motor main unit 16 about two axes, namely, the lateral axis defined by the rotatable shaft 64 and the axis perpendicular thereto defined by the rotatable shaft 66.

One end of the second hydraulic cylinder 40B (cylinder bottom 40B1) is connected to the other stern bracket 14 at a point near the lower end of the right side face thereof. Specifically, a rotatable shaft 70 that can rotate relative to the stern bracket 14 about a lateral axis is provided near the lower end of the right side face of the stern bracket 14. Further, a rotatable shaft 72 that can rotate about an axis lying perpendicular to the lateral axis is connected to the rotatable shaft 70 and the cylinder bottom 40B1 is connected to the rotatable shaft 72. In other words, the cylinder bottom 40B1 is capable of angular displacement relative to the stern bracket 14 about two axes, namely the lateral axis defined by the rotatable shaft 70 and the axis perpendicular thereto defined by the rotatable shaft 72.

The other end of the second hydraulic cylinder 40B (rod head 40B2) is connected to the right side face 16R of the outboard motor main unit 16 at a location upward of the cylinder bottom 40B1 in the vertical direction. Specifically, a rotatable shaft 74 that can rotate relative to the outboard motor main unit 16 about a lateral axis is provided on the right side face 16R at a location upward of the rotatable shafts 70, 72. Further, a rotatable shaft 76 that can rotate about an axis lying perpendicular to the lateral axis is connected to the rotatable shaft 74 and the rod head 40B2 is connected to the rotatable shaft 76. In other words, the rod head 40B2 is capable of angular displacement relative to the outboard motor main unit 16 about two axes, namely, the lateral axis defined by the rotatable shaft 74 and the axis perpendicular thereto defined by the rotatable shaft 76.

What characterizes this invention is that the steering angle and tilt/trim angles of the outboard motor main unit 16 are all regulated by controlling the amount of extension/retraction of the rods of the first and second hydraulic cylinders 40A, 40B. In other words, the two hydraulic cylinders 40A, 40B are used for both steering angle adjustment and tilt/trim angle adjustment. The operation of the hydraulic cylinders 40A, 40B will be explained in the following.

Steering angle regulation of the outboard motor main unit 16 will be explained first with reference to FIG. 6, which is an explanatory view of the outboard motor 10 seen from the top.

When the steering wheel 42 is steered (turned) by the operator, the steering angle sensor 44 sends the ECU 30 an output signal indicating the amount of steering. The ECU 30 calculates a current command value proportional to the output signal of the steering angle sensor 44. The ECU 30 sends the current command value to electric pumps (not shown) in the aforesaid hydraulic circuit, thereby operating the pumps and, in turn, operating the first hydraulic cylinder 40A and second hydraulic cylinder 40B.

Figure 6:
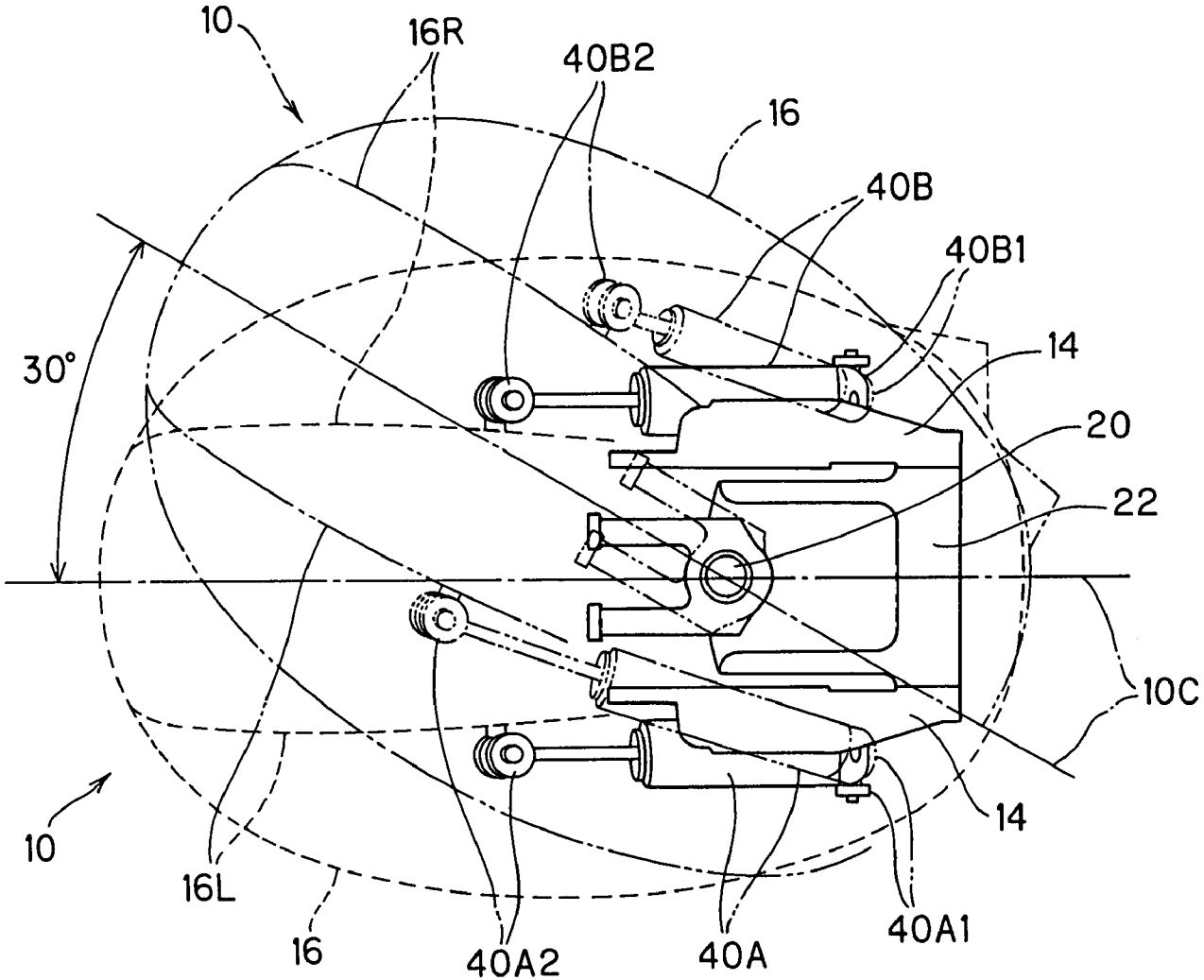
FIG. 6 is an explanatory view of the outboard motor of FIG. 1 seen from the top.

Specifically, as shown in FIG. 6, when the operator turns the steering wheel 42 counterclockwise (left), the rod of the first hydraulic cylinder 40A on the left side extends and the rod of the second hydraulic cylinder 40B on the right side retracts or contracts. As a result, the outboard motor main unit 16, including the propeller 32 and rudder 34, turns clockwise, so that the boat 12 is steered port (left). As illustrated, the maximum clockwise steering angle of the outboard motor main unit 16 is 30 degrees.

Although not illustrated, when the operator turns the steering wheel 42 clockwise (right), the rod of the first hydraulic cylinder 40A on the left side retracts and the rod of the second hydraulic cylinder 40B on the right side extends. As a result, the outboard motor main unit 16 turns counterclockwise, so that the boat 12 is steered starboard (right). The maximum counterclockwise steering angle of the outboard motor main unit 16 is 30 degrees, the same as the maximum clockwise steering angle.

The inclination of the hydraulic cylinders 40A, 40B relative to the outboard motor 10 (inclination relative to the vertical and lateral directions) changes sequentially with changing steering angle of the outboard motor main unit 16. However, as explained above, the cylinder bottoms 40A1, 40B1 and the rod heads 40A2, 40B2 of the hydraulic cylinders are free to rotate about two orthogonal axes, so that only the steering angle is changed while the tilt/trim angles are maintained unmodified.

Tilt/trim angle regulation of the outboard motor main unit 16 will be explained with reference to FIG. 7, which is an explanatory view of the outboard motor 10 seen from the left side.

The power tilt switch 50 and power trim switch 52 generate or output signals indicating tilt and trim angle regulation instructions inputted by the operator. The ECU 30 calculates current command values proportional to the output signals of the switches 50, 52. The ECU 30 sends the command values to the electric pumps in the hydraulic circuit, thereby operating the pumps and, in turn, operating the first hydraulic cylinder 40A and second hydraulic cylinder 40B.

Figure 7:
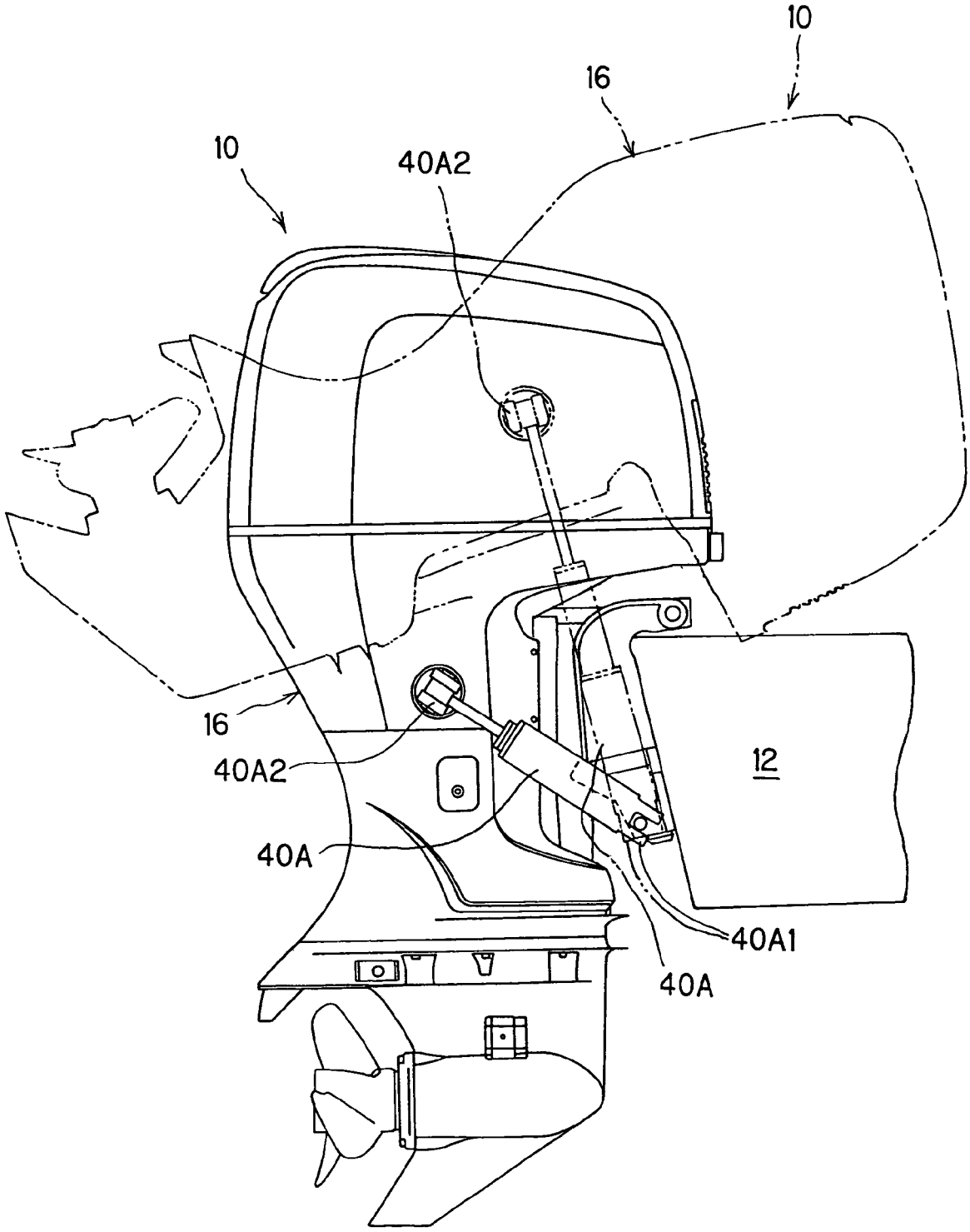
FIG. 7 is an explanatory view of the outboard motor of FIG. 1 seen from the left side.

Specifically, as shown in FIG. 7, when the operator inputs a tilt up instruction, the rods of both the first hydraulic cylinder 40A and second hydraulic cylinder 40B extend. As a result, the outboard motor main unit 16 is tilted up as shown in FIG. 7. Further, when a trim up instruction is inputted, the rods of both the first hydraulic cylinder 40A and second hydraulic cylinder 40B similarly extend. However, in the case of trimming up, the amount of extension of the rods of the hydraulic cylinders 40A, 40B is smaller than in the case of tilting up.

When the operator inputs a tilt down instruction, the rods of both the first hydraulic cylinder 40A and second hydraulic cylinder 40B retract or contract. As a result, the outboard motor main unit 16 is tilted down. Further, when a trim down instruction is inputted, the rods of both the first hydraulic cylinder 40A and second hydraulic cylinder 40B similarly retract or contract.

As stated above, this embodiment is configured to have a system for regulating steering angle and tilt/trim angle of the outboard motor 10 mounted on a stern of the boat 12 through stern brackets 14 and having the internal combustion engine 26 and the propeller 32 powered by the engine to propel the boat, comprising: the steering wheel 42 installed near a seat of an operator of the boat to be manipulated by the operator; the steering angle sensor 44 generating an output indicative of a steering angle of the steering wheel manipulated by the operator; the power tilt switch 50 operable by the operator and generating an output indicative of an instruction to tilt up/down the outboard motor, more specifically the outboard motor main unit 16 relative to the boat 12 when operated; the power trim switch 52 operable by the operator and generating an output indicative of an instruction to trim up/down the outboard motor, more specifically the outboard motor main unit 16 relative to the boat 12 when operated; a pair of hydraulic cylinders 40A, 40B each connected, at one end (cylinder bottoms 40A1, 40B1), to the boat 12 through the stern brackets 14 and connected, at the other end (rod heads 40A2, 40B2), to the outboard motor 10, more specifically the outboard motor main unit 16 at a location upward of the one end in a vertical direction (in other words, are inclined relative to the vertical direction); and the electronic control unit 30 inputting the outputs of the steering angle sensor 42, power tilt switch 50 and power trim switch 52 and selectively driving the hydraulic cylinders to extend or contract, to regulate the steering angle and tilt/trim angles of the outboard motor relative to the boat 12 in response to at least one of the inputted outputs. In other words, this embodiment is configured to share the pair of hydraulic cylinders 40A and 40B in regulating the steering angle and tilt/trim angles of the outboard motor. With this, while utilizing the hydraulic cylinders as actuators, the invention can simplify the structure when compared to the case that the actuators are independently and separately used for these angle adjustments, to improve mountability on the outboard motor 10 and hold weight increase to the minimum. While reference numbers are used above for ease of understanding the invention in relation to the present exemplary embodiments of the invention, the invention is not limited to the specific embodiments as disclosed, and use of the reference numbers should not be construed as a limitation or restriction on the scope of the claimed invention.

In the system, the other ends of the hydraulic cylinders 40A, 40B are connected to the outboard motor 10 at the opposite sides, more specifically, the other ends, or rod heads 40A2, 40B2, of the hydraulic cylinders 40A, 40B are connected at laterally symmetric positions on the opposite sides of the lateral center 10C of the outboard motor. With this, the amount of extension and retraction of the hydraulic cylinders are equal in the left and right steering, thereby ensuring regulation of the steering angle in a stable manner. In addition, since the hydraulic cylinders of the same type can be used, this is advantageous for reducing costs.

It should be noted in the above that, although two hydraulic cylinders of the first hydraulic cylinder 40A and second hydraulic cylinder 40B are used, it is possible to use three or more hydraulic cylinders.

It should also be noted that, although the cylinder bottoms (40A1, 40B1) are connected to the lower end of stern brackets 14 and the rod heads (40A2, 40B2) are connected to the side face of outboard motor main unit 16 at a location upward of the cylinder bottoms (40A1, 40B1), it is alternatively possible to configure such that the rod heads (40A2, 40B2) are connected to the lower end of stern brackets 14 and the cylinder bottoms (40A1, 40B1) are connected to the side face of outboard motor main unit 16 at a location upward of the rod heads (40A2, 40B2).

Japanese Patent Application No. 2004-165678 filed on Jun. 3, 2004 is incorporated herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. A system for regulating steering angle and tilt/trim angle of an outboard motor mounted on a stern of a boat through stern brackets and having an internal combustion engine and a propeller powered by the engine to propel the boat, comprising:

a steering wheel installed near a seat of an operator of the boat to be manipulated by the operator;

a steering angle sensor generating an output indicative of a steering angle of the steering wheel manipulated by the operator;

a power tilt switch operable by the operator and generating an output indicative of an instruction to tilt up/down the outboard motor relative to the boat when operated;

a power trim switch operable by the operator and generating an output indicative of an instruction to trim up/down the outboard motor relative to the boat when operated;

a pair of hydraulic cylinders each connected, at one end, to the boat through the stern brackets and connected, at the other end, to the outboard motor at a location upward of the one end in a vertical direction; and a control unit inputting the outputs of the steering angle sensor, power tilt switch and power trim switch and selectively driving the hydraulic cylinders to extend or retract, to regulate the steering angle and tilt/trim angles of the outboard motor relative to the boat in response to at least one of the inputted outputs.

2. The system according to claim 1, wherein the other ends of the hydraulic cylinders are connected to the outboard motor at opposite sides thereof.

3. The system according to claim 2, wherein the other ends of the hydraulic cylinders are connected at laterally symmetric positions on the opposite sides of a lateral center of the outboard motor.

4. The system according to claim 1, wherein the control unit drives one of the hydraulic cylinders to extend and the other hydraulic cylinder to retract to thereby regulate the steering angle of the outboard motor relative to the boat in response to the inputted output of the steering angle sensor.

5. The system according to claim 1, wherein the control unit drives the hydraulic cylinders to both extend or both retract to thereby change the tilt/trim angles of the outboard motor relative to the boat in response to the inputted outputs of the power trim and tilt switches.

6. The system according to claim 1, wherein the control unit selectively drives the hydraulic cylinders to change the steering angle, while maintaining the tilt/trim angles unchanged in response to the inputted output of the steering angle sensor.

7. The system according to claim 1, wherein the control unit selectively drives the hydraulic cylinders to change the tilt/trim angles, while maintaining the steering angle unchanged in response to the inputted outputs of the power trim and tilt switches.

8. The system according to claim 1, wherein each of said one ends of the hydraulic cylinders may be angularly displaced relative to a corresponding one of said stern brackets about two axes, and each of said other ends of said hydraulic cylinders may be angularly displaced relative to the outboard motor about two axes.

9. The system according to claim 8, wherein said two axes about which each of said one ends of the hydraulic cylinders may be angularly displaced are substantially perpendicular to each other, and said two axes about which each of said other ends of the hydraulic cylinder may be displaced are substantially perpendicular to each other.

* * * * *